299-13 SR
6/9/81 XR 4,272,127

United States Patent [19] [11] 4,272,127
Hutchins et al. [45] Jun. 9, 1981

[54] SUBSIDENCE CONTROL AT BOUNDARIES OF AN IN SITU OIL SHALE RETORT DEVELOPMENT REGION

[75] Inventors: Ned M. Hutchins; Irving G. Studebaker, both of Grand Junction, Colo.

[73] Assignee: Occidental Oil Shale, Inc., Grand Junction, Colo.

[21] Appl. No.: 99,531

[22] Filed: Dec. 3, 1979

[51] Int. Cl.[3] ..... E21B 43/247; E21B 43/263
[52] U.S. Cl. ..... 299/2; 166/259; 299/11; 299/13; 299/19
[58] Field of Search ..... 299/2, 19, 13, 11; 166/256, 259

[56] References Cited

U.S. PATENT DOCUMENTS

| | | | |
|---|---|---|---|
| 2,846,205 | 8/1958 | Bucky | 299/19 X |
| 3,950,029 | 4/1976 | Timmins | 299/19 X |
| 4,047,760 | 9/1977 | Ridley | 299/2 |
| 4,140,343 | 2/1979 | Mills | 299/19 X |
| 4,162,808 | 7/1979 | Kvapil et al. | 299/2 |
| 4,176,882 | 12/1979 | Studebaker et al. | 299/19 X |

OTHER PUBLICATIONS

*SME Mining Engineers Handbook,* Cummins & Given, vol. 1, Society of Mining Engineers of AIME, New York, N.Y. 1973, pp. 13-2 to 13-9.

*Primary Examiner*—Stephen J. Novosad
*Attorney, Agent, or Firm*—Christie, Parker & Hale

[57] ABSTRACT

An array of in situ oil shale retorts is formed in a development region in a subterranean formation containing oil shale. At least one void is excavated in each retort site, and remaining formation within each retort site is explosively expanded toward the void for forming a fragmented permeable mass of formation particles containing oil shale in each in situ retort. Overburden loads over an area of the development region are carried largely by the fragmented masses and partly by unfragmented partitions between retorts. Subsidence of overburden following explosive expansion is controlled at the boundary of the development region to avoid an abrupt change in the overburden load supported largely by the fragmented masses inside the boundary and the overburden load supported by unfragmented formation outside the boundary. Subsidence can be controlled by providing a gradual transition in overburden load support inside the boundary by progressively decreasing the proportion of horizontal area of formation explosively expanded to form the fragmented masses as the fragmented masses approach the boundary. This can be achieved by progressively reducing the area of the fragmented masses, or progressively spacing the fragmented masses farther apart, or both.

42 Claims, 5 Drawing Figures

SUBSIDENCE CONTROL AT BOUNDARIES OF AN IN SITU OIL SHALE RETORT DEVELOPMENT REGION

BACKGROUND

This invention relates to in situ recovery of mineral values, and more particularly to techniques for controlling subsidence of overburden adjacent the boundary of a development region containing a plurality of in situ recovery zones. More particularly it relates to controlling subsidence adjacent the boundary of a region containing a plurality of in situ oil shale retorts each containing a fragmented mass of formation particles in which oil shale is retorted for recovering shale oil.

U.S. patent application Ser. No. 878,387, filed Feb. 16, 1978, entitled IN SITU OIL SHALE RETORTS WITH GAS BARRIERS FOR MAXIMIZING PRODUCT RECOVERY, by Irving G. Studebaker and Ned M. Hutchins, and assigned to the same assignee as this application, now U.S. Pat. No. 4,176,882, describes a technique for in situ oil shale retorting wherein the load of overburden is shared by gas barriers and "fragmented masses" so that rupture of the overburden above the gas barriers is prevented. The present application concerns a transition zone between such a development and an adjacent region having overburden supported by unfragmented formation. The aforementioned patent application is incorporated herein by this reference.

The presence of large deposits of oil shale in the Rocky Mountain region of the United States has given rise to extensive efforts to develop methods of recovering shale oil form kerogen in the oil shale deposits. It should be noted that the term "oil shale" as used in the industry is in fact a misnomer; it is neither shale, nor does it contain oil. It is a sedimentary formation comprising marlstone deposit with layers containing an organic polymer called "kerogen", which, upon heating, decomposes to produce liquid and gaseous products. It is the formation containing kerogen that is called "oil shale" herein, and the liquid hydrocarbon product is called "shale oil".

A number of methods have been proposed for processing the oil shale which involve either first mining the kerogen-bearing shale and processing the shale on the surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits has been described in several patents, such as U.S. Pat. Nos. 3,661,423; 4,043,585; 4,043,596; 4,043,597 and 4,043,598, which are incorporated herein by this reference. Such patents describe in situ recovery of liquid and gaseous hydrocarbon materials from a subterranean formation containing oil shale by fragmenting such formation to form a stationary, fragmented permeable body or mass of formation particles containing oil shale within the formation, referred to herein as an in situ oil shale retort. Hot retorting gases are passed through the in situ oil shale retort to convert kerogen contained in the oil shale to liquid and gaseous products, thereby producing retorted oil shale.

One method of supplying hot retorting gases used for converting kerogen contained in the oil shale, as described in U.S. Pat. No. 3,661,423, includes establishment of a combustion zone in the retort and introduction of an oxygen-containing retort inlet mixture into the retort as an oxygen-supplying gaseous combustion zone feed to advance the combustion zone through the retort. In the combustion zone, oxygen in the combustion zone feed is depleted by reaction with hot carbonaceous materials to produce heat, combustion gas, and combusted oil shale. By the continued introduction of the retort inlet mixture into the retort, the combustion zone is advanced through the fragmented mass in the retort.

The combustion gas and the portion of the combustion zone feed that does not take part in the combustion process pass through the fragmented mass in the retort on the advancing side of the combustion zone to heat the oil shale in a retorting zone to a temperature sufficient to produce kerogen decomposition, called retorting, in the oil shale to gaseous and liquid hydrocarbon products, and to a residual solid carbonaceous material.

The liquid products and gaseous products are cooled by the cooler oil shale fragmented in the retort on the advancing side of the retorting zone. The liquid hydrocarbon products, together with water produced in or added to the retort, are collected at the bottom of the retort. An off gas containing combustion gas, including carbon dioxide generated in the combustion zone, gaseous products produced in the retorting zone, carbon dioxide from carbonate decomposition, and any gaseous retort inlet mixture that does not take part in the combustion process, is also withdrawn from the bottom of the retort. The products of retorting are referred to herein as liquid and gaseous products.

Residual carbonaceous material in the retorted oil shale can be used as fuel for advancing the combustion zone through the retorted oil shale. When the residual carbonaceous material is heated to its spontaneous ignition temperature it reacts with oxygen. As the residual carbonaceous material becomes depleted in the combustion process, the oxygen penetrates farther into the oil shale retort where it combines with remaining unoxidized residual carbonaceous material, thereby causing the combustion zone to advance through the fragmented oil shale.

It is desirable to maximize the amount of oil shale subjected to retorting within a region of formation being developed. To this end it is desirable to minimize the amount of formation excavated from each retort site when forming void volumes in preparation for explosive expansion. The mined out formation is excluded from the in situ retorting process, which can reduce the overall recovery of shale oil from the retorts. Removed formation either must be retorted by above ground techniques, or the shale oil is lost when the mined out material is discarded. Moreover, the steps of mining the shale and transporting it to above ground are expensive and time consuming.

When forming a group of in situ retorts, substantial amounts of unfragmented formation are left in the vertical partitions or barriers between adjacent fragmented masses in the group of retorts. The partitions or barriers between individual retorts contain essentially unrecoverable shale oil, but such barriers are left in place because they serve as gas barriers which make it possible to independently control retorting operations in each fragmented mass within the group of retorts, and they substantially prevent leakage of off gas into adjacent underground workings where operating personnel may be present.

During retorting, a substantial amount of the kerogen present in the partitions of unfragmented formation which provide such gas barriers is not retorted. Therefore, to maximize the yield from a group of in situ retorts, it is desirable to form gas barriers which are as thin as possible so they contain the least practical amount of kerogen while still being sufficiently thick that they can inhibit the flow of gases between adjacent retorts.

A retort development region having relatively thin gas barriers formed between retorts can experience subsidence of overburden above the retorts. When load from the overburden is carried by the fragmented masses following explosive expansion, some crushing of the particles at the particle interfaces occurs, which can result in subsidence of formation in the retort development region. Subsidence of overburden does not occur outside the retort development region where overburden is supported completely by the unfragmented formation. For example, in an exemplary embodiment where a group of retorts are formed within an outside boundary of a retort development region, about 75 to 80% of the horizontal area of formation within the development region is occupied by the fragmented masses, and about 20 to 25% of the area is in the gas barriers of unfragmented formation between the fragmented masses. Ground subsidence can occur over the development region since the overburden is supported largely by fragmented formation. Outside the boundary of the development region, where overburden is supported only by unfragmented formation, no ground subsidence occurs.

An abrupt change in subsidence can occur at the boundary of a development region having a transition between a region that has subsided and a region that is still completely supported by unfragmented formation. Such an abrupt change can cause formation to rupture along a generally vertical shear plane between the subsided region and an adjacent nonsubsided region which is completely supported by unfragmented formation. Rupture of formation along such a shear plane is to be avoided because it can cause leakage of water from overlying aquifers into retort or mining areas, leakage of gas from completed retorts, leakage of air into retort during retorting operations, and safety hazards in underground workings containing operating personnel.

Similar effects can occur in other in situ recovery techniques where a fragmented mass remains undergound. For example, it can be desirable to form a subterranean recovery zone containing a fragmented mass of ore containing metal values and then recover such metal values from the fragmented mass. A leach liquid can be percolated through such a fragmented mass for extracting metal values. Such a technique of in situ leaching can be used alone or in combination with in situ retorting of oil shale.

Thus, it is desirable to avoid abrupt changes in subsidence near the boundaries of an in situ development region containing a plurality of subterranean recovery zones, each containing a fragmented mass of particles.

SUMMARY OF THE INVENTION

A row of spaced apart in situ recovery zones such as a plurality of in situ oil shale retorts is formed in a subterranean formation containing oil shale. Each retort in such a row contains a fragmented permeable mass of formation particles containing oil shale. At least one void is excavated in each retort site, and formation within each retort site is explosively expanded toward such a void for forming a fragmented permeable mass of formation particles containing oil shale in each in situ retort. The proportion of horizontal area of formation which is explosively expanded to form the row of fragmented masses is progressively decreased along the length of the row of in situ retorts. This can provide a gradual transition between a region within the row of retorts where overburden is supported mostly by the fragmented masses and a region outside the row of retorts where overburden is supported completely by unfragmented formation.

Such a gradual transition can be provided by fragmented masses which are progressively smaller along the row of recovery zones, or spacing the fragmented masses farther part along the row of recovery zones or both. This provides a gradual transition in the proportion of overburden load supported by unfragmented formation which, in turn, can avoid an abrupt change in subsidence near the boundary of a development region.

DRAWINGS

Features of specific embodiments of the best mode contemplated for carrying out the invention are illustrated in the drawings, in which.

Figure 4:
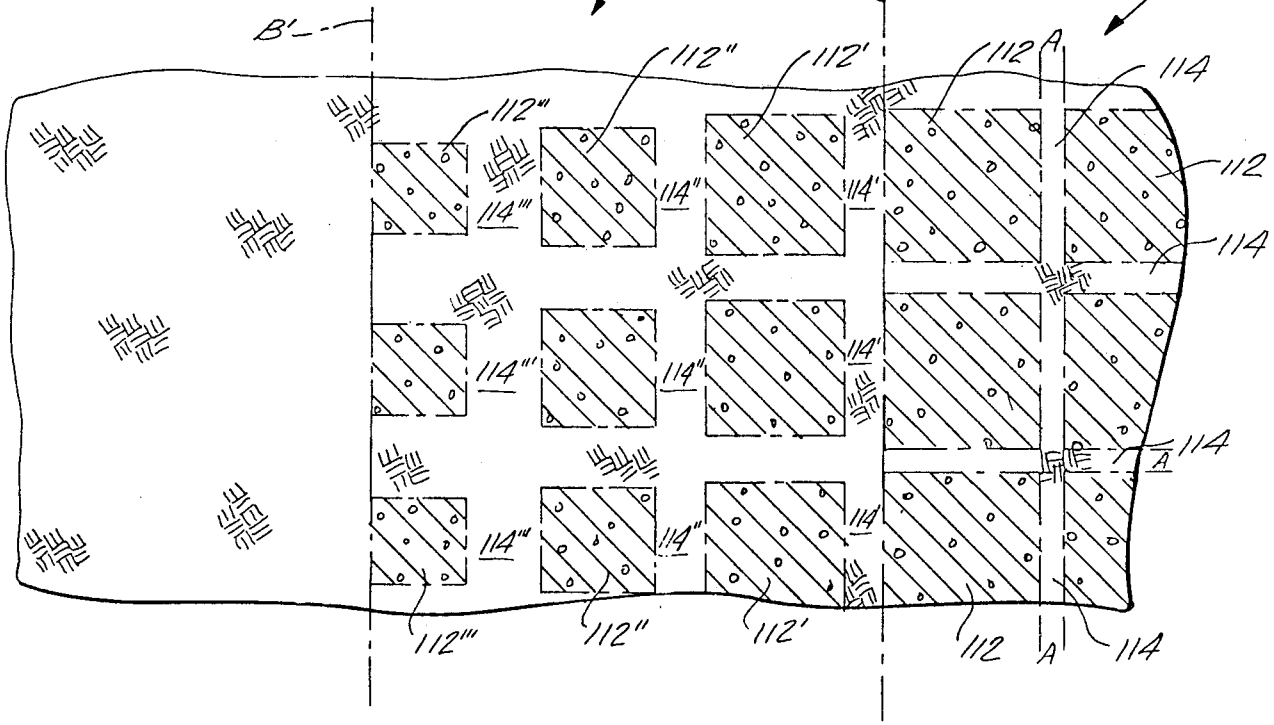
Figure 5:
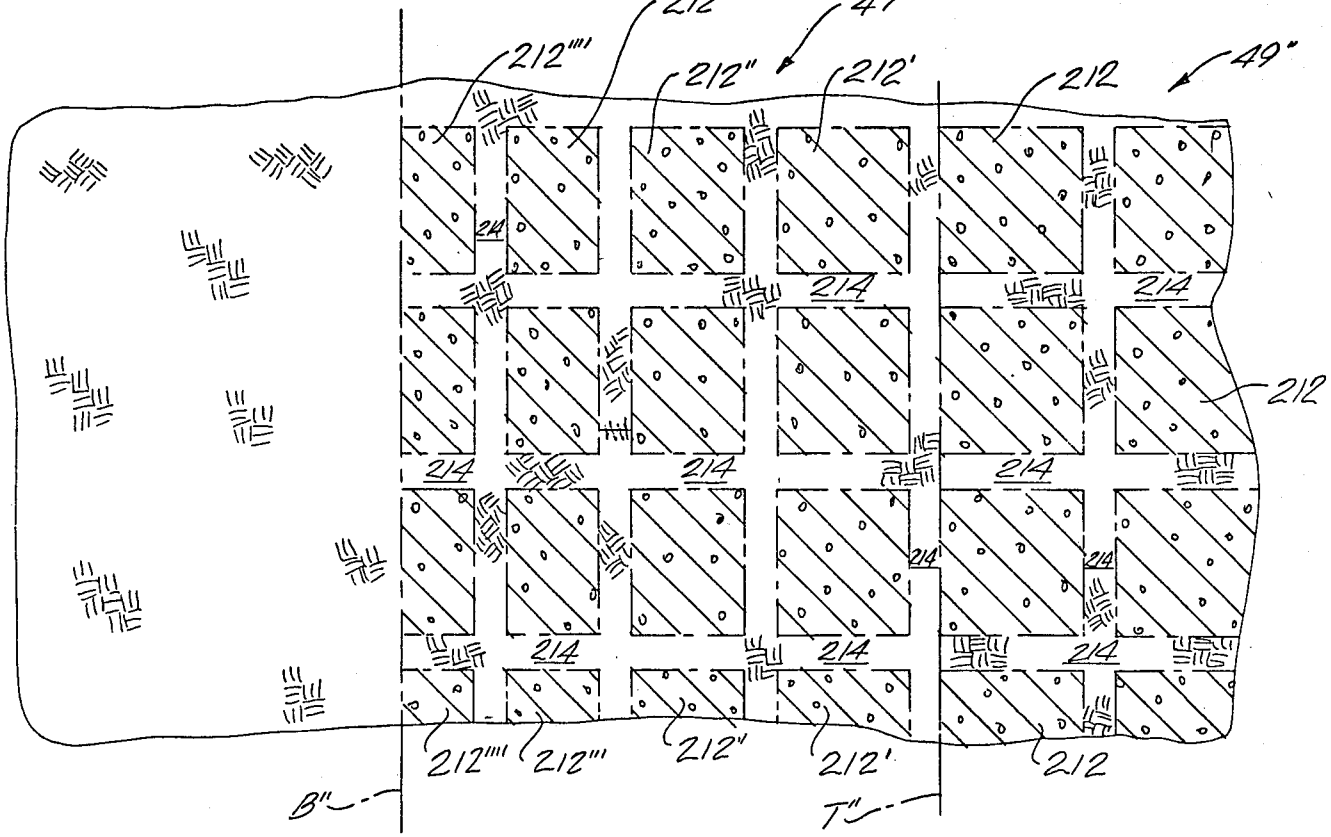

FIG. 4 is a fragmentary, semi-schematic cross-sectional top view showing an alternate form of the invention with in situ oil shale retorts which are progressively smaller in area and spaced progressively farther apart in a transition region near the boundary of a retort development region; and FIG. 5 is a fragmentary, semi-schematic cross-sectional top view showing a further alternate form of the invention with in situ oil shale retorts which are progressively smaller in area near a transition region of a retort development region.

DETAILED DESCRIPTION

Although this invention can be practiced in a variety of in situ recovery techniques such as in situ leaching of metal values, it is convenient for purposes of exposition to describe a system involving in situ oil shale retorts for retorting oil shale for producing shale oil. Therefore, referring to the drawings, a system of in situ oil shale retorts is formed in a subterranean formation 10 containing oil shale. Each retort, when completed by explosive expansion techniques, comprises a fragmented permeable mass 12 of formation particles containing oil shale having top, bottom and side boundaries. In the embodiment shown in FIG. 2, for example, the retorts are formed in a retort development region wherein retorts are horizontally spaced apart in parallel rows, leaving vertically extending partitions or gas barriers 14 of unfragmented formation between the fragmented masses of adjacent in situ retorts. Such vertical partitions 14 separate fragmented masses 12 within a given row from one another, as well as separating each fragmented mass in one row from a corresponding fragmented mass in an adjacent row. The vertical partitions 14 provide gas barriers for isolating retorting reactions in the respective fragmented masses from one another during subsequent retorting operations.

The present invention provides techniques for controlling subsidence of overburden near the tract boundary of the retort development region. By providing a gradual change in the proportionate amount of support for overburden provided by unfragmented formation within the retort development region, abrupt changes in subsidence of overburden near the tract boundary can be avoided.

Figure 1:
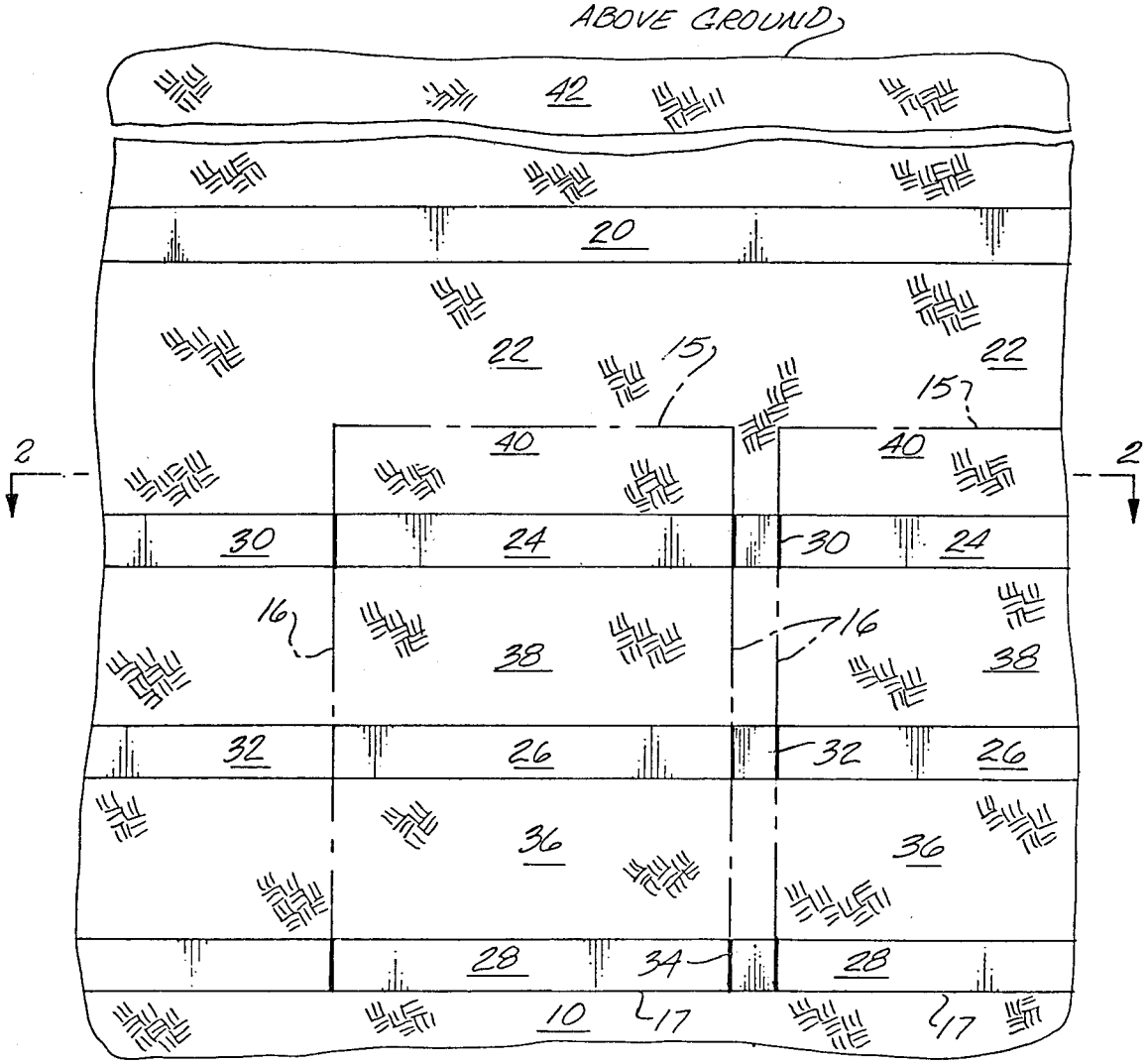
FIG. 1 is a fragmentary, semi-schematic cross-sectional side view showing a subterranean formation containing oil shale in preparation for forming a group of in situ oil shale retorts according to principles of this invention.

FIG. 1 illustrates a pair of adjacent in situ oil shale retort sites at the end of a row of in situ retorts being formed in the retort development region. The tract boundary B defining the outside of the retort development region is shown in phantom lines in the drawings. The retorts nearest the boundary are spaced a small distance therefrom to avoid any effects on adjacent property. The in situ oil shale retort sites shown in FIG. 1 are at a stage of preparation prior to explosive expansion for forming the fragmented masses 12. The in situ retorts being formed are rectangular in horizontal cross section, and as shown in FIG. 1, each retort being formed has a horizontal top boundary 15, four vertically extending side boundaries 16, and a horizontal lower boundary 17. A production level drift 18 (shown in FIG. 3) extends through unfragmented formation below the lower portions of the in situ retorts being formed. An air level drift 20 is excavated on an upper working level above the retort sites. The floor of the air level drift 20 is spaced above the upper boundary 15 of the retorts being formed, leaving a horizontal sill pillar 22 of unfragmented formation between the bottom of the air level drift 20 and the top boundary 15 of the retorts being formed. The horizontal extent of the air level drift 20 and other underground workings on the air level can be similar to the horizontal cross section of the retorts being formed so that the air level drift system can provide a base of operation for providing effective access to substantially the entire horizontal cross section of each retort being formed. Such a base of operation provides access for subsequently explosively expanding formation toward one or more voids formed within each retort site. The base of operation also facilitates introduction of oxygen supplying gas into the top of each fragmented mass 12 during subsequent retorting operations.

In preparing each retort, formation from within the boundaries of each retort site is excavated to form at least one void, leaving a remaining portion of unfragmented formation within the boundaries of the retort being formed. The remaining portion of unfragmented formation is explosively expanded toward such a void to form the fragmented permeable mass 12 of formation particles containing oil shale in the retort.

In the embodiment illustrated in FIG. 1, three vertically spaced apart, parallel horizontal voids are formed within each retort site. A rectangular upper horizontal void 24 is excavated at an upper retort access level, a rectangular intermediate horizontal void 26 is excavated at an intermediate retort access level, and a rectangular lower horizontal void 28 is excavated at a lower retort access level. The horizontal cross section of each horizontal void is substantially similar to that of the retort being formed. Pillars of unfragmented formation (not shown) can be temporarily left in each void for supporting the roof and overlying formation. In the embodiment shown, a separate retort level access drift extends through opposite side boundaries of each retort site at the level of each horizontal void, and each of such access drifts is centered in its respective horizontal void. Thus, an upper level retort access drift 30 extends through opposite side walls of the upper level void 24, an intermediate level retort access drift 32 opens through opposite side walls of the intermediate level void 26, and a lower level retort access drift 34 opens through opposite side walls of the lower level void 28. Other drift and void arrangements can be used, as desired.

The lower horizontal void 28 is formed at or near the bottom of the retort being formed, and the intermediate horizontal void 26 is spaced above the lower void 28, leaving a lower zone 36 of unfragmented formation between the lower and intermediate horizontal voids. Similarly, the upper horizontal void 24 is formed above the intermediate void 26, leaving an intermediate zone 38 of unfragmented formation between the upper and intermediate voids. An upper zone 40 of unfragmented formation remains between the top of the upper void 24 and the top boundary 15 of the fragmented mass being formed.

The horizontal voids 24, 26, 28 provide horizontal free faces toward which formation is explosively expanded for forming the fragmented permeable mass 12 of formation particles containing oil shale in each in situ retort. Further details of techniques for forming retorts using such horizontal void volumes are more fully described in U.S. Pat. Nos. 4,043,597; 4,043,598; and 4,106,814. These patents are incorporated herein by this reference.

After completing each set of upper, intermediate, and lower voids in each retort site, vertical blasting holes (not shown) are drilled in the upper, intermediate, and lower zones 40, 38, and 36, respectively, of unfragmented formation adjacent the horizontal voids. In embodiments having pillars of unfragmented formation left in the horizontal voids for roof support, blasting holes are also drilled into the pillars. The blasting holes are loaded with explosive which is detonated in a single round for explosively expanding the zones of unfragmented formation toward the horizontal free faces of formation adjacent the horizontal voids, for forming each fragmented mass 12.

Alternatively, the in situ retorts can be formed by excavating at least one columnar void such as a vertical slot (not shown) for providing vertical free faces of formation on opposite sides of the slot in each retort site. Blasting holes are drilled in unfragmented formation adjacent the vertical slot and parallel to each free face. Explosive in the blasting holes is detonated to explosively expand formation adjacent the slot toward the vertical free faces to form a fragmented permeable mass of formation particles containing oil shale within the in situ retort being formed. Further details of techniques for forming a fragmented mass from a vertical slot are disclosed in U.S. Pat. Nos. 4,043,595, and 4,043,596.

Referring again to FIG. 2, explosive expansion for forming each fragmented mass leaves vertically extending partitions or gas barriers 14 of unfragmented formation between adjacent fragmented masses in the group of retorts being formed. As a result of explosive expansion in forming the fragmented mass, load from the overburden 42 of unfragmented formation above the in situ retorts is applied to the fragmented masses. In an exemplary embodiment, the overburden is about 500 feet to about 2000 feet in depth. When the load of the overburden 42 is applied to the fragmented masses, crushing of the particles at the particle interfaces occurs, which can cause subsidence of formation resting on the fragmented masses 12. Within the portion of the retort development region remote from the tract boundary the partitions are sufficiently thin that they yield structurally under overburden loads and support proportionately about the same amount of load as the fragmented masses. Such an arrangement is described in U.S. Patent Application Ser. No. 878,387, now U.S. Pat. No. 4,176,882.

Within the retort development region subsidence of overburden can occur at a substantial distance inside the tract boundary B because the overburden is supported partly by the fragmented masses. No subsidence occurs outside the tract boundary where overburden is supported completely by unfragmented formation. An abrupt change in ground subsidence is to be avoided between the region inside the tract boundary B where subsidence occurs and the region of completely supported formation outside the tract boundary. Such an abrupt change is subsidence can occur near the tract boundary if there is an abrupt change in overburden support between a region outside the tract boundary having 100% support by unfragmented formation and a region immediately inside the tract boundary where the overburden 42 is supported mostly by the fragmented masses 12. For example, in an exemplary embodiment of a retort development region wherein retorts are spaced apart in parallel rows, about 75 to 80% of the horizontal area within the development region can be occupied by the fragmented masses, and about 20 to 25% of the area can be in the gas barriers 14 of unfragmented formation between the fragmented masses. It is desirable to minimize the amount of unfragmented formation left in the gas barriers between adjacent fragmented masses, inasmuch as product recovery from a retort development region can increase as the horizontal area occupied by fragmented masses within the development region is increased. Ground subsidence can occur above such a region having a large proportion of the overburden load supported by the fragmented masses. The present invention provides techniques for controlling ground subsidence in a transition region between a subsided retort development region and an adjacent region of formation outside the tract boundary where subsidence does not occur.

Figure 2:
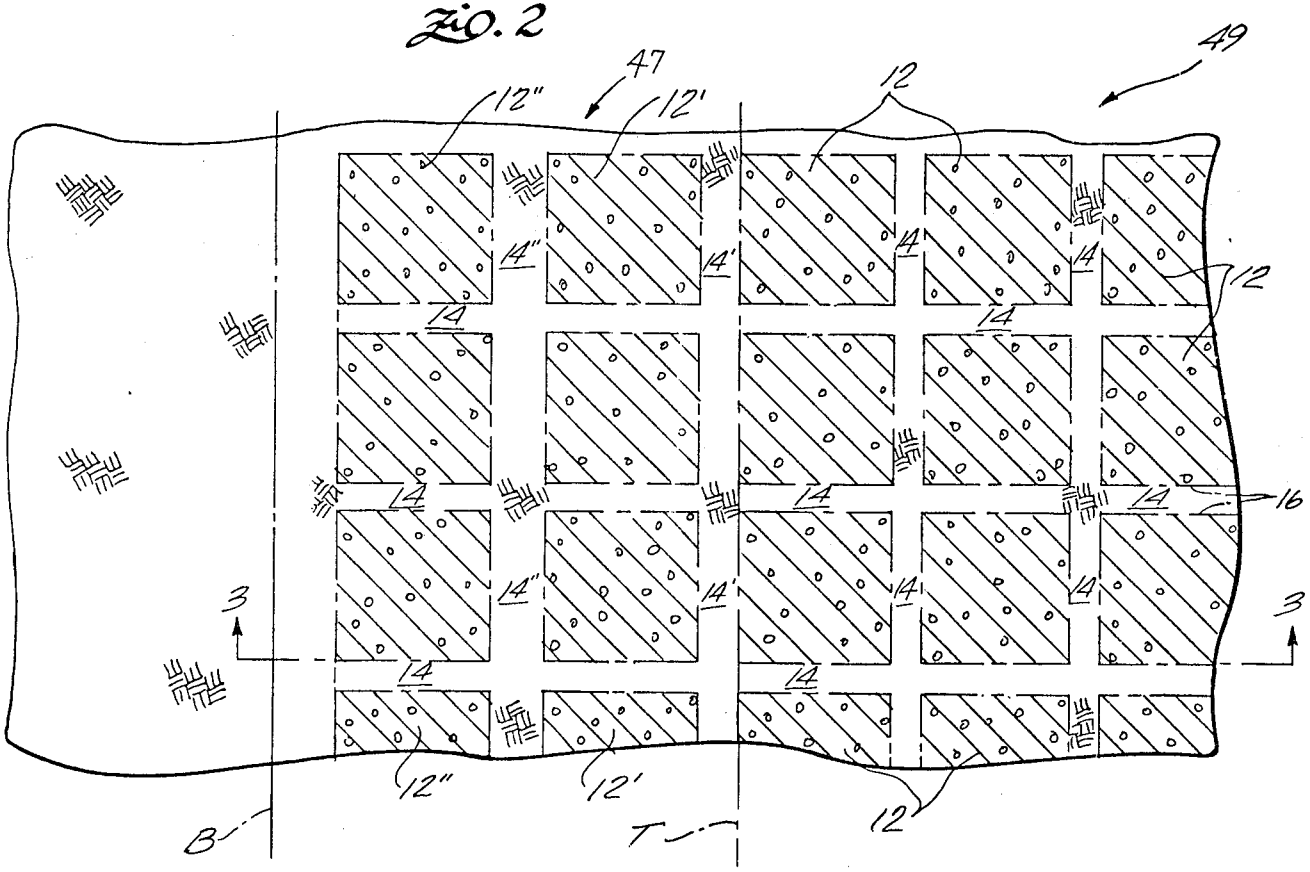
FIG. 2 is a fragmentary, semi-schematic cross-sectional top view taken on line 2—2 of FIG. 1 and showing in situ oil shale retorts which are spaced progressively farther apart in a transition region near the boundary of a retort development region.

According to the present invention, a gradual transition in overburden support is provided by a gradual increase in the proportion of overburden load supported by unfragmented formation within the retort development region near the tract boundary B. This gradual change is provided in a transition region extending from the tract boundary B (where no subsidence occurs) to a region located a substantial distance inside the tract boundary where subsidence is likely to occur. Referring to FIG. 2, the transition region is identified by reference numeral 47. The beginning of the transition region is identified by the transition boundary T, and the transition region 47 extends between the transition boundary T and the tract boundary B. In the drawing the transition boundary is indicated by a single line T, however, the boundary is not sharply defined since by its nature this development provides a gradual transition without distinct boundaries. For purposes of exposition the boundary can be considered to be the edge of the region where changes are made in the proportion of overburden load supported by fragmented and unfragmented formation, respectively, by reason of changes in the area of fragmented and unfragmented formation as compared with portions of the retort development region remote from the tract boundary.

In the transition region the proportion of horizontal area occupied by the fragmented masses 12 is progressively decreased in the direction approaching the tract boundary B. This provides a progressive increase in the proportionate amount of overburden load supported by unfragmented formation, i.e., formation within the gas barriers 14. This progressive change in overburden support can be provided by forming fragmented masses 12 which are progressively smaller in horizontal cross section, or by spacing the fragmented masses progressively farther apart, or both, as the fragmented masses approach the outside boundary of the tract.

This invention can be practiced without each successive fragmented mass in a given row being smaller in area, or each successive gas barrier being greater in thickness. Moreover, the gradual transition in load support need not be provided in every row of retorts which approaches the tract boundary. In some embodiments it can be desirable to have the width of the transition region extend an appreciable distance and the gradual change in proportionate support of overburden can include a few retorts and partitions of similar size within the transition region. Such a progressive change in overburden support is provided when a horizontal areal extent of formation having at least a pair of adjacent fragmented masses and located relatively nearer a tract boundary has proportionately less area occupied by fragmented formation and more occupied by unfragmented formation than a corresponding areal extent of formation located relatively farther from the tract boundary.

In the embodiment shown in FIG. 2, the fragmented masses 12 are formed in mutually spaced apart, parallel rows extending perpendicular to the tract boundary B. A major portion of the fragmented masses in the retort development region are formed in a main retort development region of the tract, i.e., the portion of the retort development region which is remote from the tract boundary and not within the transition region (the region shown at the right of the transition boundary T in FIG. 2 and identified by reference numeral 49). In the illustrated embodiment the fragmented masses in each row within the main retort development region 49 are equidistantly spaced apart. Each fragmented mass in a given row within the main development region 49 also is equidistantly spaced apart from a corresponding fragmented mass in an adjacent row. Thus, the gas barriers 14 which separate the fragmented masses 12 in the main retort development region 49 are essentially the same in horizontal cross-sectional thickness. In the main retort development region the fragmented masses are spaced as close together as possible to minimize the amount of essentially unrecoverable shale oil present in unfragmented formation between the fragmented masses. It is above this region, wherein formation is mostly fragmented, where subsidence can occur.

In the transition region 47, the fragmented masses are progressively spaced farther apart as the fragmented masses in each row approach the tract boundary. With reference to FIG. 2, the fragmented masses within the main retort development region 49 are spaced closest together, providing gas barriers or partitions 14 of minimum thickness in that region of the tract. In the transition region 47, a first fragmented mass 12' nearer the inside of the transition region (i.e., more remote from the tract boundary B) is spaced from an adjacent fragmented mass 12 in the main development region 49 of the tract by a first gas barrier 14' having a horizontal thickness greater than the average thickness of the gas barriers 14 within the main retort development region 49. Each row of retorts in the transition region also has a second fragmented mass 12'' at the end of the row adjacent the tract boundary. The second fragmented mass 12'' is spaced from its adjacent first fragmented mass 12' by a second gas barrier 14'' having a horizontal thickness greater than that of the first gas barrier 14'. In the embodiment shown in FIG. 2, the spacing between rows of fragmented masses is essentially the same so that the gas barriers between adjacent rows in the transition region 47 have a thickness essentially equal to that of the gas barriers within the main retort development region 49.

The retort system shown in FIG. 2 provides a gradual reduction in the amount of overburden load supported by the fragmented masses within the transition region 47 and a gradual increase in the amount of overburden load supported by the unfragmented partitions between retorts. By supporting proportionately more of the overburden on unfragmented partitions in the direction approaching the tract boundary, an abrupt change in overburden support is avoided between the portion of the tract where support is provided mostly by the fragmented masses and the region of formation immediately outside the tract boundary where overburden is supported completely by unfragmented formation. By providing such a gradual increase in the transition region, flexing of the overburden 42 can occur at elevations above the retorts across the transition region 47, rather than such formation rupturing or fracturing. Rupture of formation along a shear plane between the subsided region and the nonsubsided region avoids leakage of water from overlying aquifers into retort or mining areas, leakage of gas from spent retorts, leakage of air into retorts being processed, and safety hazards in underground workings.

Such flexing of formation above the retorts in the transition region depends on properties of the formation such as its strength and elasticity and presence of planes of weakness such as minor faults. The width of the transition region is influenced by the arching distance or span of such formation and is preferably two or three times the arching distance to permit gradual change in areal support for overburden. Thus in a formation containing oil shale the transition region can be several hundred feet wide. It can be desirable to have differing widths of transition region adjacent different boundaries of the tract to conform with different geologic conditions or overburden depths or to minimize changes in surface drainage patterns where subsidence reaches the ground surface.

Other arrangements can also be provided for transition between a region with sufficiently uniform support for overburden by the fragmented masses and intervening partitions to have reasonably uniform subsidence of overburden and a region with overburden supported by unfragmented formation. Common to many of these is a progressive decrease in the ratio of the areal extent of the fragmented masses in the retorts in the array to the areal extent of the unfragmented formation in the partitions.

FIG. 4 shows an alternate form of the invention wherein partitions of unfragmented formation within the retort development region progressively support a proportionately greater amount of load from the overburden at elevations above the fragmented masses as the fragmented masses in each row approach the zone of unfragmented formation outside the tract boundary B' of the development region. In the embodiment shown in FIG. 4, a plurality of spaced apart parallel rows of retorts extend perpendicular to the tract boundary B'. Fragmented masses 112 within a main development region 49' of the tract are equidistantly spaced apart in each row, and each fragmented mass in a given row is equidistantly spaced apart from corresponding fragmented masses in adjacent rows. Thus, gas barriers 114 of equal thickness separate the fragmented masses in the main retort development region 49'.

A transition boundary T' indicates the boundary of a transition region 47' between the tract boundary and the main development region 49'. In the transition region 47' the fragmented masses in each row are progressively smaller in horizontal cross-sectional areas as the fragmented masses approach the tract boundary. In addition, the fragmented masses in each row are progressively spaced farther apart as the fragmented masses approach the outside boundary. Thus, each row within the transition region includes a first fragmented mass 112' located nearest the transition boundary T' and spaced from an adjacent fragmented mass 122 in the main retort region 49' by a first gas barrier 114' having a thickness greater than the average spacing between retorts in the main retort region 49'. The first fragmented mass 112' is also smaller in horizontal cross section than the adjacent fragmented mass 112 inside the main retort development region 49'. A second fragmented mass 112'' in about the middle of the transition region is spaced from the first fragmented mass 112' by a second gas barrier 114'' having a thickness greater than that of the first gas barrier 114'. The second fragmented mass is smaller in horizontal cross section than the first fragmented mass 112'. Similarly, a third fragmented mass 112''' at the edge of the transition region adjacent the tract boundary is spaced from the second fragmented mass 112'' by a third gas barrier 114''' having a wall thickness greater than that of the second gas barrier 114''. The third fragmented mass is smaller in horizontal cross section than the second fragmented mass 112''. Inasmuch as the fragmented masses become progressively smaller, and the distances between them become progressively wider, as the fragmented masses approach the outside boundary, the spacing between corresponding retorts in adjacent rows also becomes progressively larger as the retorts approach the tract boundary. The retort system shown in FIG. 4 provides a greater rate of change in load support provided by unfragmented formation in the transition region than the rate of change provided by the embodiment shown in FIG. 2, for example.

FIG. 5 shows a further alternate form of the invention wherein a plurality of parallel rows of in situ retorts are formed and in which the spacing between adjacent fragmented masses in a given row, as well as between fragmented masses in adjacent rows, is the same throughout a transition region 47″ as well as in a main retort development region 49″. The fragmented masses in each row of retorts within the transition region 47″ are progressively smaller in horizontal cross-sectional area as the fragmented masses approach an outside boundary B″ of the retort development region. Thus, each row of retorts within the transition region 49″ in FIG. 5 includes a first fragmented mass 212′ located nearest the transition boundary T″ of the transition region and having a first horizontal cross-sectional area. A second fragmented mass 212″ adjacent the first fragmented mass 212′ has a second horizontal cross-sectional area smaller than the area of the first fragmented mass 212′. A third fragmented mass 212‴ spaced from the second fragmented mass 212′ has a horizontal cross-sectional area smaller than that of the second fragmented mass 212″. A fourth fragmented mass 212⁗ located at the end of the row adjacent the tract boundary B″ has a horizontal cross-sectional area smaller than that of the third fragmented mass 212‴.

The arrangements of retorts shown in FIGS. 2, 4 and 5 are by way of example only. The horizontal cross-sectional configuration of the fragmented masses in the transition region can differ, and the number of retorts within each transition region can also differ, consistent with providing a gradual decrease in the amount of overburden load supported by the fragmented masses as the fragmented masses within the transition region approach the tract boundary. Thus, for example, the retorts within the retort development region can be rectangular instead of square as illustrated. Retorts in the transition region can have a horizontal cross section that is trapezoidal with the narrower edge nearer the tract boundary and the base nearer the interior of the development region. Gas barriers between such retorts can be generally wedge-shaped thereby providing a gradual transition in the proportion of overburden loads supported by fragmented and unfragmented formation, respectively.

Figure 3:
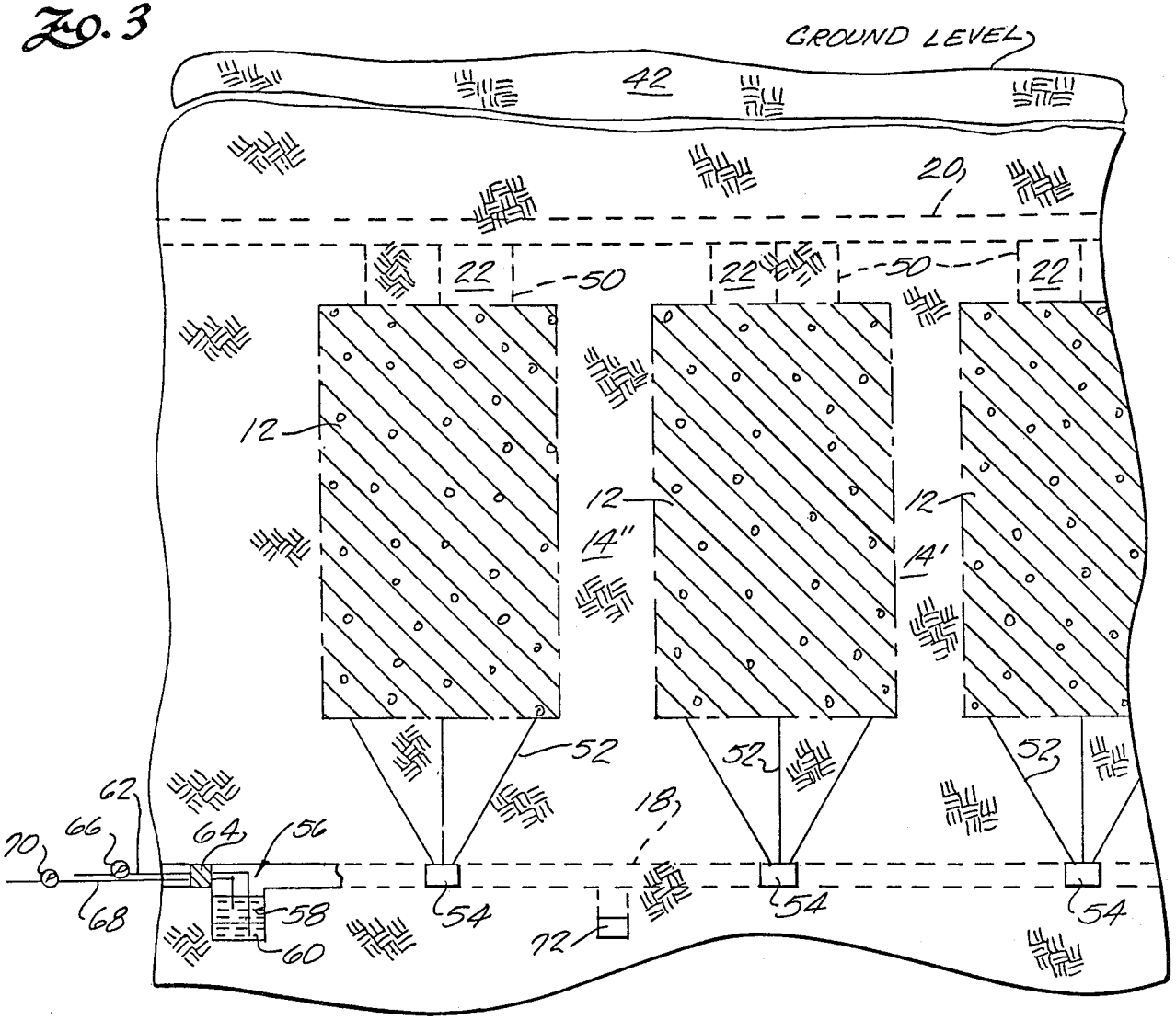
FIG. 3 is a fragmentary, semi-schematic cross-sectional side view taken on line 3—3 of FIG. 2 and showing a row of spaced apart completed in situ oil shale retorts.

After some of the fragmented masses 12 are formed in a retort development region, the final preparation steps for producing liquid and gaseous products are carried out. Referring to FIG. 3, these steps include drilling a plurality of feed gas inlet passages 50 downwardly from the air level drift 20 to the top boundary of each fragmented mass 12 so that oxygen containing gas can be supplied to each fragmented mass during retorting operations. Similarly, a plurality of bore holes or raises 52 are drilled upwardly from stub drifts 54 adjacent the production level drift 18 to the bottom boundary of each fragmented mass 12 to provide product withdrawal passages for removal of liquid and gaseous products from the fragmented mass. The inlet passages 50 and product withdrawal passages 52 can be formed before explosive expansion, if desired. Other arrangements for introducing gas and withdrawing liquid and gaseous products can be used, such as for example, forming a fragmented mass of particles having a portion extending down to the level of the stud drifts 54 or with other communication with a production level drift adjacent the bottom boundary of the retort.

During retorting operations, formation particles at the top of each fragmented mass are ignited to establish a combustion zone at the top of such a fragmented mass. Air or other oxygen supplying gas is supplied to the combustion zone from the air level drift 20 through the sill pillar 22 to the top of the fragmented mass. Air or other oxygen supplying gas introduced to the fragmented mass maintains the combustion zone and advances it downwardly through the fragmented mass. Combustion gas produced in the combustion zone passes through the fragmented mass to establish a retorting zone on the advancing side of the combustion zone wherein kerogen in the fragmented mass is converted to liquid and gaseous products. As the retorting zone moves down through the fragmented mass, liquid and gaseous products are released from the fragmented formation particles. A sump 56 in a portion of the production level drift 18 beyond the fragmented masses collects liquid products, namely, shale oil 58 and water 60, produced during operation of the retort. A water withdrawal line 62 extends from near the bottom of the sump out through a sealed opening in a bulkhead 64 sealed across the production level drift 18. An oil withdrawal line 68 extends from an intermediate level in the sump out through a sealed opening in the bulkhead and is connected to an oil pump 70. The oil and water pumps can be operated manually or by automatic controls (not shown) to remove shale oil and water separately from the sump. Off gas including gaseous products is withdrawn to a gas collection drift 72 extending at an elevation lower than the elevation of the production level drift 18. Off gas is withdrawn from the gas collection drift and passed to above ground.

Thus, practice of the present invention provides a system of in situ recovery zones wherein subsidence of overburden near a tract boundary is controlled by providing a gradual transition in support for the load from the overburden near the tract boundary. Such a gradual transition permits formation to flex and avoids abrupt changes in subsidence at the tract boundary which, in turn, inhibits the chances of shearing or fracturing of overburden near the tract boundary. The invention promotes maximizing the area within the development region which is fragmented, and therefore product yield, since subsidence over the fragmented masses can be allowed to occur while subsidence in the transition region near the tract boundary is being controlled. The same technique can be used to provide a transition region adjacent shaft pillars or other regions of unfragmented formation within a tract as well as at tract boundaries.

What is claimed is:

1. A method for recovering liquid and gaseous products from a row of spaced apart in situ oil shale retorts in a subterranean formation containing oil shale, each retort in such a row containing a fragmented permeable mass of formation particles containing oil shale, said row being formed within boundaries of unfragmented formation and having at least one end adjacent such a boundary, the method comprising the steps of:

excavating at least one void in each in situ oil shale retort site, leaving a remaining portion of unfragmented formation adjacent such a void in each in situ retort site;

explosively expanding such a portion of unfragmented formation toward such a void for forming a fragmented permeable mass of formation particles containing oil shale in each such in situ oil shale retort, the proportion of horizontal cross-sectional area of formation explosively expanded to form the fragmented masses relative to the horizontal cross-sectional areas of unfragmented formation left between adjacent fragmented masses being greater in the mid-portion of such row than at the end of such row adjacent to a boundary of unfragmented formation;

establishing a combustion zone in such a fragmented mass;

introducing an oxygen supplying gas to such fragmented mass for sustaining the combustion zone in the fragmented mass and for advancing the combustion zone through the fragmented mass, and for retorting oil shale to produce liquid and gaseous products in a retorting zone on the advancing side of the combustion zone;

withdrawing such liquid and gaseous products from the fragmented mass on the advancing side of the retorting zone.

2. The method according to claim 1 including explosively expanding formation to leave vertically extending partitions of unfragmented formation between adjacent retorts in the row of in situ oil shale retorts, the horizontal cross-sectional thickness of the partitions progressively increasing as the row of retorts approaches such a boundary for progressively decreasing the proportion of horizontal cross-sectional area of formation explosively expanded to form the fragmented masses.

3. A method for recovering liquid and gaseous products from a row of spaced apart in situ oil shale retorts in a subterranean formation containing oil shale, each retort in such a row containing a fragmented permeable mass of formation particles containing oil shale, the method comprising the steps of:

excavating at least one void in each in situ oil shale retort site within a row of spaced apart in situ oil shale retorts being formed, leaving a remaining portion of unfragmented formation adjacent such a void in each in situ retort site;

explosively expanding such a portion of unfragmented formation toward such a void for forming a fragmented permeable mass of formation particles containing oil shale in each in situ oil shale retort within such a row of spaced apart in situ retorts, the proportion of horizontal area of formation explosively expanded to form the fragmented masses relative to the horizontal areas of unfragmented formation left between adjacent fragmented masses progressively decreasing along an end portion of the row of in situ retorts, the fragmented masses in the row of in situ retorts have progressively smaller horizontal cross-sectional areas along the end portion of the row of retorts;

establishing a combustion zone in such a fragmented mass;

introducing an oxygen supplying gas to such fragmented mass for sustaining the combustion zone in the fragmented mass and for advancing the combustion zone through the fragmented mass, and for retorting oil shale to produce liquid and gaseous products in a retorting zone on the advancing side of the combustion zone;

withdrawing such liquid and gaseous products from the fragmented mass on the advancing side of the retorting zone.

4. The method according to claim 3 including explosively expanding formation to leave vertically extending partitions of unfragmented formation between adjacent pairs of fragmented masses in the row of in situ oil shale retorts, the horizontal cross-sectional thickness of the partitions progressively increasing along the end portion of the row of retorts for progressively decreasing the proportion of horizontal area of formation explosively expanded to form the fragmented masses.

5. A method for controlling subsidence of overburden at elevations above an array of in situ oil shale retorts formed within boundaries of unfragmented formation in a subterranean formation containing oil shale, the array having at least one portion thereof adjacent to such a boundary comprising explosively expanding formation within a plurality of horizontally spaced apart in situ oil shale retort sites for forming within each retort site a fragmented permeable mass of formation particles containing oil shale, such retorts being separated by vertically extending partitions of unfragmented formation, the fragmented masses being formed so they progressively support proportionately less of the load from overburden at elevations above such in situ retorts and such partitions of unfragmented formation porgressively support proportionately more of the load of such overburden as the array approaches the portion thereof adjacent to such a boundary.

6. The method according to claim 5 wherein the horizontal cross-sectional thickness of such partitions of unfragmented formation between adjacent fragmented masses progressively increases along an end portion of the row of in situ retorts.

7. A method for controlling subsidence of overburden at elevations above an array of in situ oil shale retorts formed in a subterranean formation containing oil shale, comprising explosively expanding formation within a plurality of adjacent in situ oil shale retort sites for forming a fragmented permeable mass of formation particles containing oil shale within each of a plurality of horizontally spaced apart in situ oil shale retorts, such retorts being separated by vertically extending partitions of unfragmented formation, the fragmented masses being formed so that the horizontal cross-sectional areas of the fragmented masses progressively decrease along an end portion of the row of retorts and they progressively support proportionately less of the load from overburden at elevations above a row of such in situ retorts and such partitions of unfragmented formation progressively support proportionately more of the load of overburden in a direction extending along the length of the row of retorts.

8. The method according to claim 7 wherein the horizontal thickness of such partitions between adjacent fragmented masses is about the same along the row of retorts.

9. The method according to claim 6 wherein the horizontal cross-sectional thickness of such partitions of unfragmented formation between adjacent fragmented masses progressively increases along the end portion of the row of in situ retorts.

10. A system of spaced apart in situ oil shale retorts in a subterranean formation containing oil shale, each in situ retort containing a fragmented permeable mass of formation particles containing oil shale, the fragmented masses in adjacent in situ retorts being separated by vertically extending partitions of unfragmented formation, the array having an outside boundary adjacent a zone of unfragmented formation having sufficient horizontal cross-sectional thickness that the unfragmented formation supports the load of the overburden at elevations above such zone, the fragmented masses being formed so that the partitions of unfragmented formation remote from the outside boundary of the system support proportionately about the same amount of load from overburden at elevations above the in situ retorts as do fragmented masses adjacent to such partitions and such partitions of unfragmented formation near the outside boundary of such system support a proportionately greater amount of load from overburden at elevations above the in situ retorts than do the partitions remote from the outside boundary of the system.

11. The system according to claim 10 wherein at least a portion of the fragmented masses are formed in a row extending horizontally toward the boundary of the zone of unfragmented formation; and wherein the horizontal cross-sectional thickness of the partitions of unfragmented formation between adjacent retorts in such a row progressively increases approaching the zone of unfragmented formation.

12. The system according to claim 11 wherein the horizontal cross-sectional areas of the fragmented masses in such a row progressively decrease approaching the zone of unfragmented formation.

13. The system according to claim 12 wherein such fragmented masses are formed in an array of a plurality of such rows and the horizontal cross-sectional thickness of partitions of unfragmented formation between adjacent rows progressively increases approaching the zone of unfragmented formation.

14. The system according to claim 10 wherein at least a portion of the fragmented masses are formed in a row extending horizontally toward the zone of unfragmented formation; and wherein the horizontal cross-sectional area of the fragmented masses in such a row progressively decreases approaching the zone of unfragmented formation.

15. The system according to claim 14 wherein the thickness of the partitions of unfragmented formation between adjacent fragmented masses is about the same along the row of retorts.

16. In a method for forming a row of in situ oil shale retorts within the boundaries of a zone of unfragmented formation in a subterranean formation containing oil shale, the row having at least one end thereof adjacent to such a boundary and the retorts in such row supporting a load imposed by overburden at elevations above such a row wherein formation within the retorts in such a row is explosively expanded to thereby form a fragmented permeable mass of formation particles containing oil shale in each of such retorts adjacent fragmented masses being separated by partitions of unfragmented formation, the improvement comprising gradually decreasing the proportion of horizontal cross-sectional area occupied by the fragmented masses relative to the horizontal cross sectional area occupied by such partitions from a retort in such row of retorts remote from such boundary to a retort adjacent to such boundary for gradually increasing support provided by the partitions for the load imposed by overburden at elevations above the row of retorts.

17. The improvement according to claim 16 wherein the partitions of unfragmented formation are progressively thicker in horizontal cross section as the row of retorts approaches such boundary.

18. In a method for forming a plurality of in situ oil shale retorts in a subterranean formation containing oil shale, wherein formation within a row of spaced apart in situ oil shale retort sites is explosively expanded to form a fragmented permeable mass of formation particles containing oil shale in each of a plurality of in situ oil shale retorts in a row of such retorts, adjacent fragmented masses being separated by partitions of unfragmented formation, the improvement comprising explosively expanding formation so that the fragmented masses have gradually decreasing horizontal cross-sectional areas along the end portion of the row of retorts for gradually decreasing the proportion of horizontal cross-sectional area occupied by the fragmented masses relative to the horizontal cross-sectional area occupied by such portions of unfragmented formation along an end portion of the row of in situ retorts so as to gradually increase support provided by unfragmented formation for the load imposed by overburden at elevations above the row of retorts.

19. The improvement according to claim 18 including explosively expanding formation so that the partitions of unfragmented formation are gradually thicker in horizontal cross section along the end portion of the row of retorts.

20. An array of in situ oil shale retorts within boundaries of unfragmented formation in a subterranean formation containing oil shale, each such in situ oil shale retort containing a fragmented permeable mass of formation particles containing oil shale and being separated from adjacent in situ retorts by vertically extending partitions of unfragmented formation, said array comprising a first region of retorts remote from a boundary of the array wherein the ratio of horizontal areal extent of the fragmented masses in such retorts to the horizontal areal extent of unfragmented formation in such partitions is such that overburden at elevations above the retorts in the first region is supported primarily by such fragmented masses, and a second transition region adjacent a boundary of the array wherein the ratio of the horizontal areal extent of the fragmented masses in the retorts in the second region to the horizontal areal extent of unfragmented formation in partitions adjacent thereto progressively decreases as the retorts in such second region approach such boundary.

21. An array of in situ oil shale retorts as recited in claim 20 wherein the horizontal areal extent of the fragmented masses in the in situ retorts in the transition region is less than the horizontal areal extent of the fragmented masses in the retorts in the first region remote from the boundary of the array.

22. An array of in situ oil shale retorts as recited in claim 21 wherein the horizontal areal extent of the partitions between adjacent retorts in the transition region is greater than the horizontal areal extent of the partitions in the first region remote from the boundary of the array.

23. An array of in situ oil shale retorts as recited in claim 20 wherein the horizontal areal extent of the partitions between adjacent retorts in the transition region is greater than the horizontal areal extent of the partitions in the first region remote from the boundary of the array.

24. An array of in situ oil shale retorts as recited in claim 20 wherein the horizontal areal extent of the fragmented masses in the situ retorts in the transition region progressively decreases toward such boundary.

25. An array of in situ oil shale retorts as recited in claim 24 wherein the horizontal areal extent of the partitions in the transition region progressively increases toward such boundary.

26. An array of in situ oil shale retorts as recited in claim 20 wherein the horizontal areal extent of the partitions in the transition region progressively increases toward such boundary.

27. An array of in situ recovery zones in a subterranean formation, each of such in situ recovery zones containing a fragmented permeable mass of formation particles, and being separated from adjacent recovery zones by partitions of unfragmented formation, said array having a boundary adjacent a region where overburden above said region is supported substantially entirely by unfragmented formation, said array comprising:

a first region of in situ recovery zones remote from such a boundary having sufficiently uniform support for overburden by the fragmented masses and partitions to permit substantially uniform subsidence of overburden; and a second transition region of in situ recovery zones extending between the first region and such a boundary, such transition region having progressively increasing support for overburden above the recovery zones therein as such recovery zones progress from the first region towards such a boundary for decreasing subsidence between the first region and the adjacent boundary sufficiently gradually to permit overburden in such transition region to flex substantially without rupture.

28. An array of in situ recovery zones as recited in claim 27 wherein the recovery zones in the transition region have progressively smaller horizontal cross-sectional areas towards the boundary.

29. An array of in situ recovery zones as recited in claim 28 wherein the partitions between adjacent recovery zones in the transition region are progressively thicker towards the boundary.

30. An array of in situ recovery zones as recited in claim 27 wherein the partitions between adjacent recovery zones in the transition region are progressively thicker towards the boundary.

31. A method for controlling subsidence of overburden at elevations above an array of in situ recovery zones formed within boundaries of unfragmented formation in a subterranean formation, comprising explosively expanding formation within a plurality of adjacent sites for forming a fragmented permeable mass of formation particles within each of a plurality of horizontally spaced apart in situ recovery zones, such recovery zones being separated by vertically extending partitions of unfragmented formation, the fragmented masses being formed so they progressively support proportionately less of the load from overburden at elevations above a row of such recovery zones, and such partitions of unfragmented formation progressively support proportionately more of the load of such overburden in a direction extending along the length of the row of recovery zones toward such a boundary in an end portion of the row adjacent such boundary.

32. The method according to claim 31 comprising explosively expanding such formation so that the horizontal cross-sectional areas of the fragmented masses progressively decrease along the end portion of the row of recovery zones adjacent such boundary.

33. The method according to claim 32 wherein the horizontal thickness of such partitions between adjacent fragmented masses is about the same along the row of recovery zones.

34. The method according to claim 32 wherein the horizontal cross-sectional thickness of such partitions of unfragmented formation between adjacent fragmented masses progressively increases along the end portion of the row of recovery zones as the row progresses toward such boundary.

35. The method according to claim 31 wherein the horizontal cross-sectional thickness of such partitions of unfragmented formation between adjacent fragmented masses progressively increases along the end portion of the row of recovery zones adjacent such boundary.

36. An array of in situ recovery zones within boundaries of unfragmented formation in a subterranean formation, each such recovery zone containing a fragmented permeable mass of formation particles and being separated from adjacent in situ recovery zones by vertically extending partitions of unfragmented formation, said array comprising a first region of recovery zones remote from a boundary of the array wherein the ratio of horizontal areal extent of the fragmented masses in such recovery zones to the horizontal areal extent of unfragmented formation in such partitions is such that overburden at elevations above the recovery zones in such first region is supported primarily by such fragmented masses, and a second transition region adjacent a boundary of the array wherein the ratio of the horizontal areal extent of the fragmented masses in such recovery zones to the horizontal areal extent of unfragmented formation in such partitions progressively decreases toward such boundary such that the overburden at elevations above the recovery zones in such second transition region is progressively supported more by the partitions than by the fragmented masses in the recovery zones as the recovery zones approach such boundary.

37. An array of in situ recovery zones as recited in claim 36 wherein the horizontal areal extent of the fragmented masses in the recovery zones in the transition region is less than the horizontal extent of the fragmented mass in the recovery zones in the first region remote from the boundary of the array.

38. An array of in situ oil shale retorts as recited in claim 37 wherein the horizontal areal extent of the partitions between adjacent recovery zones in the transition region is greater than the horizontal areal extent of the partitions in the first region remote from the boundary of the array.

39. An array of in situ recovery zones as recited in claim 36 wherein the horizontal areal extent of the partitions between adjacent recovery zones in the transition region is greater than the horizontal areal extent of the partitions in the first region remote from the boundary of the array.

40. An array of in situ recovery zones as recited in claim 36 wherein the horizontal areal extent of the fragmented masses in the recovery zones in the transition region progressively decreases toward such boundary.

41. An array of in situ recovery zones as recited in claim 40 wherein the horizontal areal extent of the partitions in the transition region progressively increases toward such boundary.

42. An array of in situ recovery zones as recited in claim 36 wherein the horizontal areal extent of the partitions in the transition region progressively increases toward such boundary.

* * * * *

UNITED STATES PATENT AND TRADEMARK OFFICE

CERTIFICATE OF CORRECTION

PATENT NO. : 4,272,127

DATED : June 9, 1981

INVENTOR(S) : Ned M. Hutchins, Irving G. Studebaker

It is certified that error appears in the above—identified patent and that said Letters Patent is hereby corrected as shown below:

Column 1, line 34, "form" should be -- from --;
Column 1, line 54, "4,043,585" should be -- 4,043,595 --.
Column 7, line 30, "is" should be -- in --.
Column 13, line 1, -- such -- should be inserted after "to" and before "a".
Column 16, line 59, -- in -- should be inserted after "the" and before "situ".
Column 18, line 18, -- the -- should be inserted after "of" and before "horizontal";
Column 18, line 38, -- areal -- should be inserted after "horizontal" and before "extent".

Signed and Sealed this

*Thirty-first* Day of *August 1982*

[SEAL]

*Attest:*

GERALD J. MOSSINGHOFF

*Attesting Officer*

*Commissioner of Patents and Trademarks*